US010400658B2

(12) United States Patent
Yin et al.

(10) Patent No.: US 10,400,658 B2
(45) Date of Patent: Sep. 3, 2019

(54) INTELLIGENT SEA WATER COOLING SYSTEM AND METHOD

(71) Applicant: CIRCOR PUMPS NORTH AMERICA, LLC, Monroe, NC (US)

(72) Inventors: Dan Yin, Waxhaw, NC (US); Stefan Werner, Constance (DE); Christian Martin, Radolfzell (DE); Martin Hoffmann, Moos (DE); David McKinstry, Charlotte, NC (US)

(73) Assignee: CIRCOR PUMPS NORTH AMERICA, LLC, Monroe, NC (US)

( * ) Notice: Subject to any disclaimer, the term of this patent is extended or adjusted under 35 U.S.C. 154(b) by 182 days.

(21) Appl. No.: 15/549,196

(22) PCT Filed: Feb. 13, 2015

(86) PCT No.: PCT/US2015/015881

§ 371 (c)(1),
(2) Date: Aug. 7, 2017

(87) PCT Pub. No.: WO2016/130149

PCT Pub. Date: Aug. 18, 2016

(65) Prior Publication Data

US 2018/0016965 A1 Jan. 18, 2018

(51) Int. Cl.

| | |
|---|---|
| ***F01P 3/20*** | (2006.01) |
| ***F01P 7/16*** | (2006.01) |
| ***F28F 27/00*** | (2006.01) |

(52) U.S. Cl.

CPC ..... *F01P 3/207* (2013.01); *F01P 7/164* (2013.01); *F28F 27/00* (2013.01); *F28F 2250/08* (2013.01)

(58) Field of Classification Search

CPC .. F01P 3/207; F01P 7/164; F01P 7/165; F01P 7/162; F01P 2007/146; F28F 27/00

See application file for complete search history.

(56) References Cited

U.S. PATENT DOCUMENTS

| | | | |
|---|---|---|---|
| 7,048,044 | B2 | 5/2006 | Ban et al. |
| 2002/0152972 | A1 | 10/2002 | Iwasaki et al. |

(Continued)

FOREIGN PATENT DOCUMENTS

| | | | |
|---|---|---|---|
| DE | 217274 | A1 | 1/1985 |
| EP | 2762802 | A2 | 8/2014 |

(Continued)

OTHER PUBLICATIONS

International Search Report and Written Opinion dated Oct. 21, 2015 for PCT/US2015/015881 filed Feb. 13, 2015.

(Continued)

*Primary Examiner* — Jacob M Amick

(57) ABSTRACT

An intelligent sea water cooling system including a first fluid cooling loop coupled to a first side of a heat exchanger and to a thermal load, a second fluid cooling loop coupled to a second side of the heat exchanger, a pump for circulating fluid through the second fluid cooling loop, and a controller connected to the pump. The controller may monitor a temperature in the first fluid cooling loop and may adjust a speed of the pump to keep the temperature within a preferred operating range. If the speed of the pump is reduced to a predefined minimum pressure pump speed, the controller may start a timer t1 having a predefined duration. If the timer t1 expires and the temperature has not increased relative to when the timer t1 was started, the controller may reduce the speed of the pump below the minimum pressure pump speed.

20 Claims, 10 Drawing Sheets

(56) References Cited

U.S. PATENT DOCUMENTS

| | | | | |
|---|---|---|---|---|
| 2012/0090823 | A1 | 4/2012 | Labaste Mauhe et al. | |
| 2016/0031542 | A1 * | 2/2016 | Yin | F01P 3/207 700/282 |

FOREIGN PATENT DOCUMENTS

| | | | |
|---|---|---|---|
| FR | 1237044 | A | 7/1960 |
| JP | 10979036 | A | 3/1997 |
| WO | 2009139201 | A1 | 11/2009 |
| WO | WO2014172153 | A1 | 10/2014 |

OTHER PUBLICATIONS

European Search Report dated May 25, 2018 for European Patent Application No. 15882231.2.

* cited by examiner

INTELLIGENT SEA WATER COOLING SYSTEM AND METHOD

FIELD OF THE DISCLOSURE

The disclosure is generally related to the field of sea water cooling systems, and more particularly to a system and method for controlling the temperature in a fresh water cooling loop by regulating pump speed in a sea water cooling loop thermally coupled thereto.

BACKGROUND OF THE DISCLOSURE

Large seafaring vessels are commonly powered by large internal combustion engines that require continuous cooling under various operating conditions, such as during high speed cruising, low speed operation when approaching ports, and full speed operation for avoiding bad weather, for example. Existing systems for achieving such cooling typically include one or more pumps that draw sea water into heat exchangers onboard a vessel. The heat exchangers are used to cool a closed, fresh water cooling loop that flows through and cools the engine(s) of the vessel as well as various other thermal loads onboard the vessel that require cooling (e.g., air conditioning systems).

A shortcoming associated with existing sea water cooling systems such as the one described above is that they are generally inefficient. Particularly, pumps that are employed to draw sea water into such systems are typically operated at a constant speed regardless of the amount of sea water necessary to achieve sufficient cooling of an associated engine. Thus, if an engine does not require a great deal of cooling, such as when the engine is idling or is operating at low speeds, or if the sea water being drawn into a cooling system is very cold, the pumps of the cooling system may provide more water than is necessary to achieve sufficient cooling. A portion of the energy expended to drive the pumps is therefore wasted. The pumps may be shut down to conserve energy, but will soon have to be restarted once the engine temperature rises above an acceptable limit. Of course, if the engine is still idling or is operating at low speed when the pumps are restated, or if the sea water being pumped into the system is still very cold when the pumps are restarted, the pumps will soon be shut down again once the engine temperature falls. This type of continuous on-off operation of the pumps can place a great deal of mechanical stress on the pumps as well associated system components.

SUMMARY

In view of the foregoing, it would be advantageous to provide an intelligent sea water cooling system and method that provide improved efficiency and fuel savings relative to existing sea water cooling systems and methods.

An exemplary embodiment of an intelligent sea water cooling system in accordance with the present disclosure may include a first fluid cooling loop coupled to a first side of a heat exchanger and to a thermal load, a second fluid cooling loop coupled to a second side of the heat exchanger, a pump configured to circulate fluid through the second fluid cooling loop, and a controller connected to the pump. The controller may monitor a temperature in the first fluid cooling loop and may adjust a speed of the pump to keep the temperature within a preferred operating range. If the speed of the pump is reduced to a predefined minimum pressure pump speed (e.g., a pump speed that is necessary to maintain a predefined minimum system pressure), the controller may start a timer t1 having a predefined duration (e.g., 5 minutes). If the timer t1 expires and the temperature has not increased relative to when the timer t1 was started, the controller may reduce the speed of the pump below the minimum pressure pump speed.

An exemplary embodiment of a method for operating an intelligent sea water cooling system having a first fluid cooling loop coupled to a first side of a heat exchanger and to a thermal load, a second fluid cooling loop coupled to a second side of the heat exchanger, and a pump for circulating fluid through the second fluid cooling loop may include monitoring an temperature in the first fluid cooling loop and adjusting a speed of the pump to keep the temperature within a preferred operating range. If the speed of the pump is reduced to a predefined minimum pressure pump speed, the method may further include starting a timer t1 having a predefined duration. If the timer t1 expires and the temperature has not increased relative to when the timer t1 was started, the method may further include reducing the speed of the pump below the minimum pressure pump speed.

BRIEF DESCRIPTION OF THE DRAWINGS

By way of example, specific embodiments of the disclosed device will now be described with reference to the accompanying drawings, in which.

DETAILED DESCRIPTION

Figure 1:
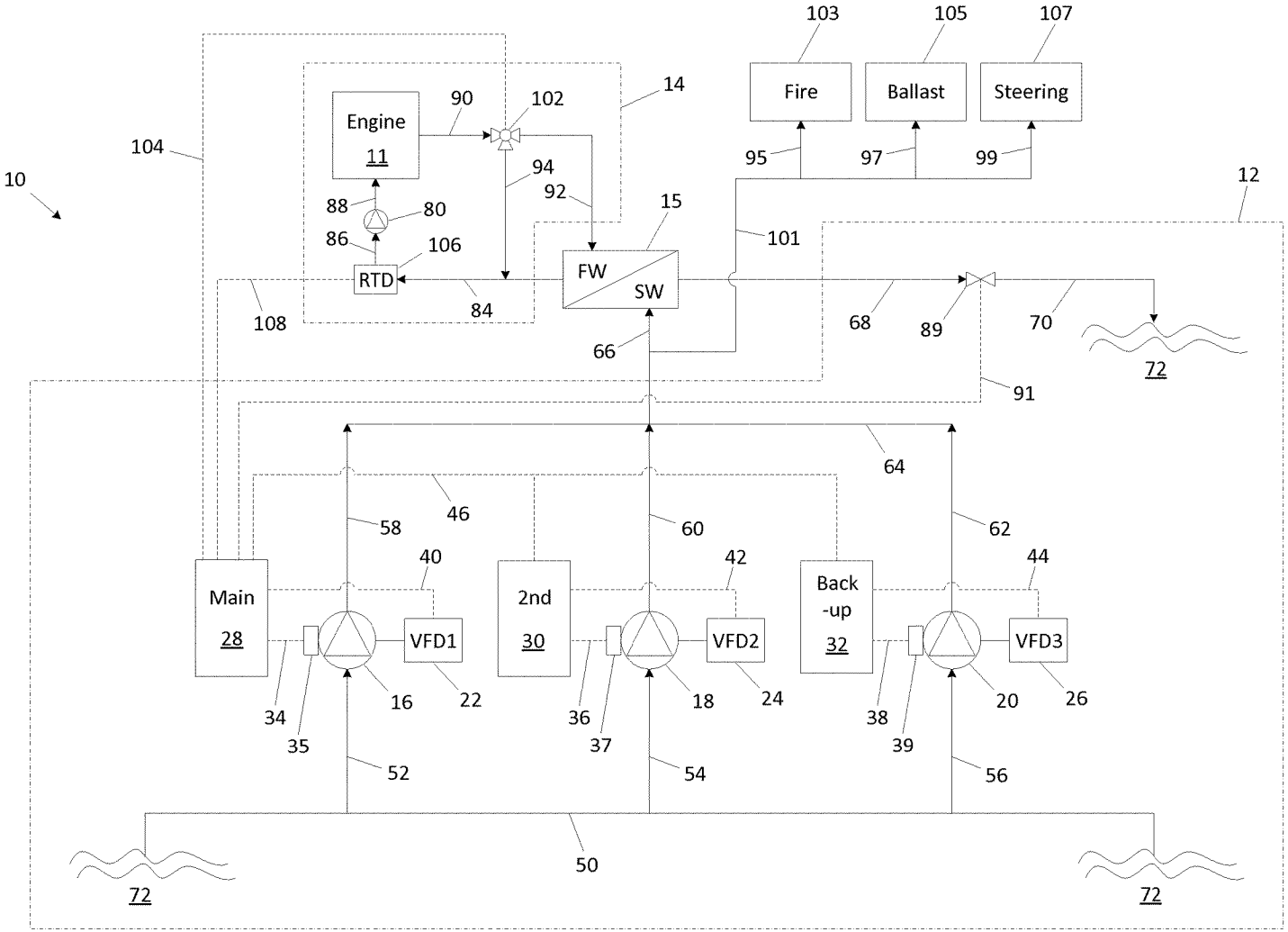
FIG. 1 is a schematic view illustrating an exemplary embodiment of an intelligent sea water cooling system in accordance with the present disclosure.

An intelligent sea water cooling system and methods in accordance with the present disclosure will now be described more fully hereinafter with reference to the accompanying drawings, in which exemplary embodiments of the system and methods are shown. The disclosed system and methods, however, may be embodied in many different forms and should not be construed as limited to the embodiments set forth herein. Rather, these embodiments are provided so that this disclosure will be thorough and complete, and will fully convey the scope of the present disclosure to those skilled in the art. In the drawings, like numbers refer to like elements throughout.

Referring to FIG. 1, a schematic representation of an exemplary intelligent sea water cooling system 10 (hereinafter "the system 10") is shown. The system 10 may be installed onboard any type of seafaring vessel or offshore platform having one or more engines 11 that require cooling. Only a single engine 11 is shown in FIG. 1, but it will be appreciated by those of ordinary skill in the art the engine 11 may be representative of a plurality of engines or various other loads onboard a vessel or platform that may be coupled to the cooling system 10.

The system 10 may include a first fluid cooling loop, hereinafter referred to as "the sea water cooling loop 12," and second fluid cooling loop, hereinafter referred to as "the fresh water cooling loop 14," that are thermally coupled to one another by a heat exchanger 15 as further described below. Only a single heat exchanger 15 is shown in FIG. 1, but it is contemplated that the system 10 may alternatively include two or more heat exchangers for providing greater thermal transfer between the sea water cooling loop 12 and the fresh water cooling loop 14 without departing from the present disclosure.

The sea water cooling loop 12 of the system 10 may include a main pump 16, a secondary pump 18, and a backup pump 20, though it is contemplated that the system 10 may be implemented using a more or fewer pumps without departing from the present disclosure. The pumps 16-20 may be driven by respective variable frequency drives 22, 24, and 26 (hereinafter "VFDs 22, 24, and 26"). The pumps 16-20 may be centrifugal pumps, but it is contemplated that the system 10 may alternatively or additionally include various other types of pumps, including, but not limited to, gear pumps, progressing cavity pumps, or multi-spindle screw pumps, or other positive-displacement pumps or other non-positive displacement pumps.

If the system 10 includes three pumps 16-20 as shown in FIG. 1, the system 10 may be operated as a so-called "3×50%" system, wherein two of the pumps (e.g., pumps 16 and 18) are operated simultaneously, each providing 50% of the sea water pressure in the system 10, and the third pump (e.g., pump 20) is kept idle and is used as a backup pump. Alternatively, if the system 10 only includes two pumps (e.g., pumps 16 and 18), then the system 10 may be operated as a so-called "2×100%" system, wherein only one of the pumps (e.g., pump 16) is operated to provide 100% of the sea water pressure in the system 10, and the second pump (e.g., pump 18) is kept idle and is used as a backup pump. Of course, a system having three pumps may also be operated as a 2×100% system, wherein one of the pumps is operated to provide 100% of the sea water pressure in the system, and both the second and third pumps are kept idle and are used as backup pumps.

The VFDs 22-26 may be operatively connected to respective main, secondary, and backup controllers 28, 30, and 32 via communications links 40, 42, and 44. Various sensors and monitoring devices 35, 37, and 39, including, but not limited to, vibration sensors, pressure sensors, bearing temperature sensors, leakage sensors, and other possible sensors, may be operatively mounted to the pumps 16, 18 and 20 and connected to the corresponding controllers 28, 30 and 32 via the communications links 34, 36, and 38. These sensors may be provided for monitoring the health of the pumps 16, 18, and 20 as further described below.

The controllers 28-32 may further be connected to one another by communications link 46. The communications link 46 may be transparent to other networks, providing supervising communication capability. The controllers 28-32 may be configured to control the operation of the VFDs 22-26 (and therefore the operation of the pumps 16-20) to regulate the flow of sea water to the heat exchanger 15 as further described below. The controllers 28-32 may be any suitable types of controllers, including, but not limited to, proportional-integral-derivative (PID) controllers and/or a programmable logic controllers (PLCs). The controllers 28-32 may include respective memory units and processors (not shown) that may be configured to receive and store data provided by various sensors in the cooling system 10, to communicate data between controllers and networks outside of the system 10, and to store and execute software instructions for performing the method steps of the present disclosure as described below.

An operator may establish a plurality of pump parameters at the controller 28, VFD 22, or other user interface. Such pump parameters may include, but are not limited to, a reference speed, a reference efficiency, a reference flow, a reference head, a reference pressure, speed limits, suction pressure limits, discharge pressure limits, bearing temperature limits, and vibration limits. These parameters may be provided by a pump manufacturer (such as in a reference manual) and may be entered into the controller 28, VFD 22, or other user interface by the operator or by external supervising devices via the communications link 46. Alternatively, it is contemplated that the controller 28, VFD 22, or other user interface may be preprogrammed with pump parameters for a plurality of different types of commercially available pumps, and that the operator may simply specify the type of pumps that are currently being used by the system 10 to load a corresponding set of parameters. It is further contemplated that the controller 28 or VFD 22 may be configured to automatically determine the type of pumps that are connected in the system 10 and to load a corresponding set of parameters without any operator input.

An operator may also establish a plurality of system parameters at the controller 28, VFD 22, or other user interface. Such parameters may include, but are not limited to, a fresh water temperature range, a VFD motor speed range, a minimum pressure level, a fresh water flow, a water heat capacity coefficient, a heat exchanger surface area, a heat transfer coefficient, presence of a 3-way valve, and ambient temperature limits.

Pump parameters and system parameters that are established at the controller 28 or VFD 22 may be copied to the other controllers 30 and 32 and/or to the other VFDs 24 and 26, such as via transmission of corresponding data through the communications link 46. Such copying of the parameters may be performed automatically or upon entry of an appropriate command by the operator at the controller 28, VFD 22, or other user interface. The operator is therefore only required to enter the parameters once at a single interface instead of having to enter the parameters at each controller 28-32 and/or VFD 22-26 as in other pump systems.

The communications links 34-46, as well as communications links 81, 104 and 108 described below, are illustrated as being hard wired connections. It will be appreciated, however, that the communications links 34-46, 91, 104 and 108 of the system 10 may be embodied by any of a variety of wireless or hard-wired connections. For example, the communications links 34-46, 91, 104 and 108 may be implemented using Wi-Fi, Bluetooth, PSTN (Public Switched Telephone Network), a satellite network system, a cellular network such as, for example, a GSM (Global System for Mobile Communications) network for SMS and packet voice communication, General Packet Radio Service (GPRS) network for packet data and voice communication, or a wired data network such as, for example, Ethernet/Internet for TCP/IP, VOIP communication, etc.

The sea water cooling loop 12 may include various piping and piping system components ("piping") 50, 52, 54, 56, 58, 60, 62, 64, 66, 68, 70 for drawing water from the sea 72, through the pumps 16-20, and for circulating the sea water through the sea water cooling loop 12, including a sea water side of the heat exchanger 15, as further described below. The piping 50-70, as well as piping 84, 86, 88, 90, 92, 94, 95, 97, 99, and 101 of the fresh water cooling loop 14 and the additional systems 103, 105, and 107 described below, may be any type of rigid or flexible conduits, pipes, tubes, or ducts that are suitable for conveying sea water, and may be arranged in any suitable configuration aboard a vessel or platform as may be appropriate for a particular application.

The sea water cooling loop 12 may further include a discharge valve 89 disposed intermediate the conduits 68 and 70 and connected to the main controller 28 via communications link 91. It is contemplated that the discharge valve 89 may also be connected to the secondary controller 30 and/or the backup controller 32, as these controllers may automatically identify the connected discharge valve 89 and may automatically distribute information pertaining to the connection of the discharge valve 89 to one another via the communications link 46. The discharge valve 89 may be adjustably opened and closed to vary the pressure of sea water in the system 10 without varying the speed of the pumps 16-20 as further described below. In one non-limiting exemplary embodiment, the discharge valve 89 is a throttle valve.

The fresh water cooling loop 14 of the system 10 may be a closed fluid loop that includes a fluid pump 80 and various piping and components 84, 86, 88, 90, 92, and 94 for continuously pumping and conveying fresh water through the heat exchanger 15 and the engine 11 for cooling the engine 11 as further described below. The fresh water cooling loop 14 may further include a 3-way valve 102 that is connected to the main controller 28 via communications link 104 for controllably allowing a specified quantity of water in the fresh water cooling loop 14 to bypass the heat exchanger 15 as further described below.

A temperature in the fresh water cooling loop 14 may be measured and monitored by the main controller 28 to facilitate various control operations of the cooling system 10. Such temperature measurement may be performed by a resistance temperature detector 106 (hereinafter "RTD 106") or other temperature measurement device that is operatively connected to the fresh water cooling loop 14. The RTD 106 is shown in FIG. 1 as measuring the temperature of the fresh water cooling loop 14 on the inlet side of the engine 11, but it is contemplated that the RTD 106 may alternatively or additionally measure the temperature of the fresh water cooling loop 14 on the outlet side of the engine 11. The RTD 106 may be connected to the main controller 28 by communications link 108 or, alternatively, may be an integral, onboard component of the main controller 28. It is contemplated that the RTD 106 may also be connected to the secondary controller 30 and/or the backup controller 32, as these controllers may automatically identify the connected RTD 106 and may automatically distribute information pertaining to the connection of the RTD 106 to one another via the communications link 46.

The sea water cooling loop 12 may additionally provide sea water to various other systems of a vessel or platform for facilitating the operation of such systems. For example, sea water from the sea water cooling loop 12 may be provided to one or more of a fire suppression system 103, a ballast control system 105, and/or a sea water steering system 107 on an as-needed basis. Although not shown, other sea water-operated systems that may receive sea water from the sea water cooling loop 12 in a similar manner include, but are not limited to, sewage blowdown, deck washing, air conditioning, and freshwater generation.

In the exemplary system 10 shown in FIG. 1, sea water may be provided to the systems 103-107 via piping 95, 97, 99, and 101, which may be connected to the sea water cooling loop 12 at piping 66, for example. The piping 95-101 may be provided with various manually or automatically controlled valves (not shown) for directing the flow of sea water into the systems 103-107 in a desired manner. Of course, it will be appreciated that if sea water is supplied to the systems 103-107, the flow of sea water through the heat exchanger 15 will be reduced, which may cause the temperature in the fresh water cooling loop 14 to rise unless the operation of the pumps 16-20 is modified. The pumps 16-20 may therefore be controlled in manner that compensates for the use of sea water by the systems 103-107 as will described in greater detail below.

During normal operation of the system 10, hereinafter referred to as the "default operating mode," the main and secondary controllers 28 and 30 may command the VFDs 22 and 24 to drive at least one of the pumps 16 and 18. For example, only one of the pumps 16 and 18 may be driven if the system 10 has a 2×100% configuration, and both of the pumps 16 and 18 may be driven if the system has a 3×50% configuration. For purposes of illustration, the system 10 will hereinafter be described as having a 3×50% configuration, with the pumps 16 and 18 being driven simultaneously and with pump 20 being idle and serving as a backup pump, unless otherwise noted.

The pumps 16 and 18 may pump sea water from the sea 72 to the heat exchanger 15, as well as to any of the other sea water-operated systems 103-107. As the sea water flows through the heat exchanger 15, it may cool the fresh water in the fresh water cooling loop 14 which simultaneously flows through the heat exchanger 15. The cooled fresh water thereafter flows through, and cools, the engine 11.

The main controller 28 may monitor the temperature of the fresh water in the fresh water cooling loop 14 via the RTD 106. The main controller 28 may compare the monitored temperature to a predefined temperature range (e.g. 33-37 degrees Fahrenheit), hereinafter referred to as the "preferred operating range," in order to determine whether the engine 11 is being sufficiently cooled. If the main controller 28 determines that the monitored temperature of the fresh water exceeds, or is about to exceed, the preferred operating range, the main controller 28 may increase the speed of the VFD 22 and may issue a command to the secondary controller 30 to increase the speed of the VFD 24. The corresponding main and/or secondary pumps 16 and 18 are thereby driven faster, and the flow of sea water through the sea water cooling loop 12 is increased. Greater cooling is thereby provided at the heat exchanger 15, and the temperature in the fresh water cooling loop 14 is resultantly decreased. The main controller 28 may additionally command the 3-way valve 102 to adjust its position, thereby adjusting the amount of fresh water that flows through the heat exchanger 15 in order to achieve optimal cooling of the fresh water.

Conversely, if the main controller 28 determines that the monitored temperature of the fresh water in the fresh water cooling loop 14 is below, or is about to fall below, the preferred operating range, the main controller 28 may decrease the speed of the VFD 22 and may issue a command to the secondary controller 30 to decrease the speed of the VFD 24. The corresponding main and secondary pumps 16 and 18 are thereby driven more slowly, and the flow of sea water through the sea water cooling loop 12 is decreased. Less cooling is thereby provided at the heat exchanger 15 and the temperature in the fresh water cooling loop 14 is resultantly increased. The main controller 28 may additionally command the 3-way valve 102 to adjust its position, thereby diverting some or all of the fresh water in the fresh water cooling loop 14 to bypass the heat exchanger 15 in order to further reduce the cooling of the fresh water.

The main controller 28 may also continuously or periodically monitor the efficiency of the system 10 in order to determine whether the system 10 should switch between one-pump operation and two-pump operation in order to achieve a desired efficiency. That is, it may be more efficient in some situations to drive only one of the pumps 16 or 18 and not the other. Alternatively, it may be more efficient and/or necessary to drive both of the pumps 16 and 18. The main controller 28 may make such a determination by comparing the operating speeds of the pumps 16 and 18 to predefined "switch points." "Switch points" may be threshold operating speed values that are used to determine whether the system 10 should switch from two-pump operation to one-pump operation or vice versa. For example, if the system 10 is running both of the pumps 16 and 18 and both of the pumps 16 and 18 are being driven at less than a predetermined percentage of their maximum operating speeds, the main controller 28 may deactivate the secondary pump 18 and run only the main pump 16. Conversely, if the system 10 is running only the main pump 16 and the main pump 16 is being driven at greater than a predetermined percentage of its maximum operating speed, the main controller 28 may activate the secondary pump 18.

Figure 2:
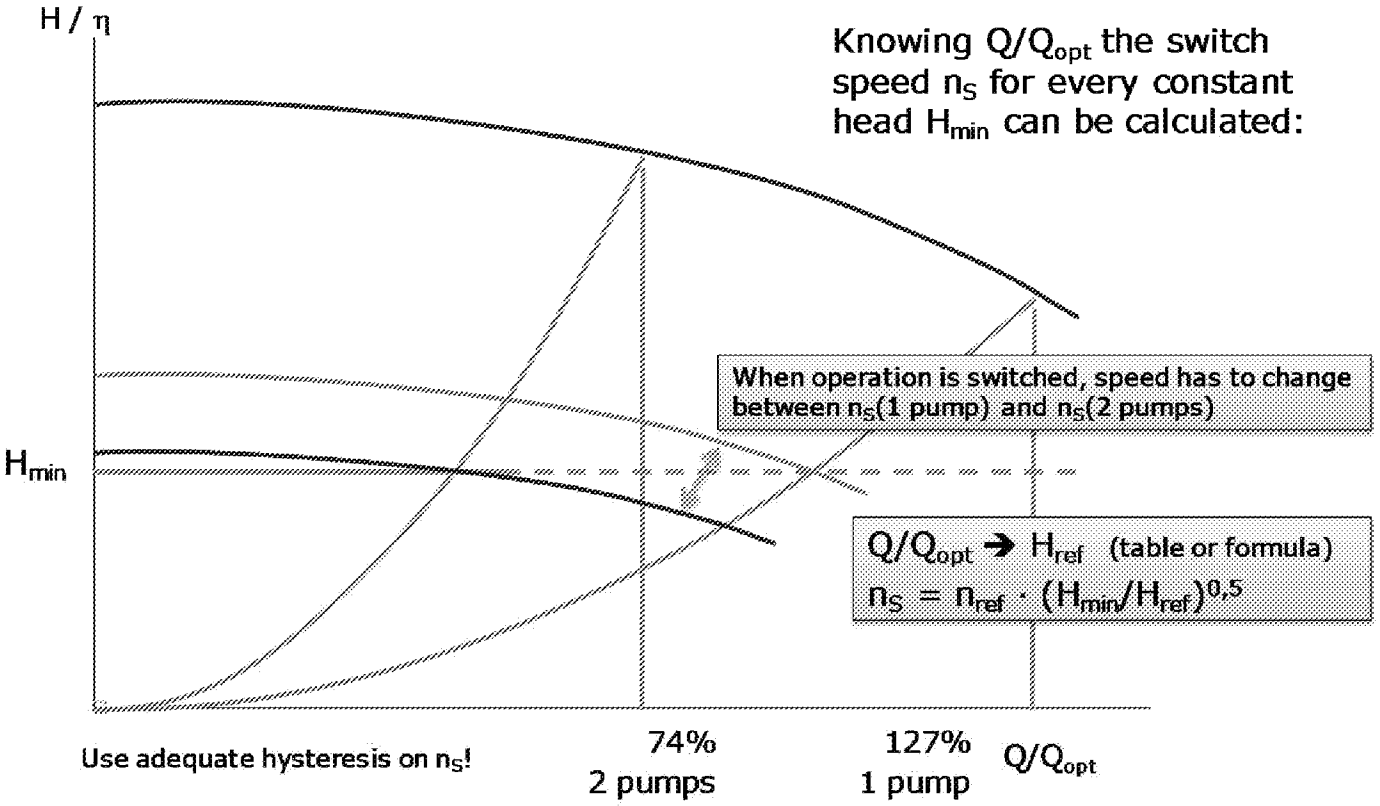
FIG. 2 is a graph illustrating exemplary means for determining whether to operate the system of the present disclosure with one pump or two pumps.

As shown in FIG. 2, the switch points (between one and two pump operation) may be determined by calculating a system efficiency that is equal to a ratio of an actual flow rate "Q" in the system 10 and a predetermined optimal flow rate "Qopt" for the system. The system efficiency can then be compared to predetermined values to determine whether the system should switch between one-pump and two-pump operation. For example, according to the curve in shown in FIG. 2, when Q/Qopt exceeds 127% under one-pump operation, the system 10 can switch to two-pump operation to operate most efficiently. Likewise, when Q/Qopt falls below 74% under two-pump operation, the system 10 can switch to one-pump operation.

Regardless of how little sea water is required by the system 10 at any given time, the system 10 may operate one or both of the pumps 16-20 in manner that will keep a ship's system pressure at or above a predetermined (e.g., pre-calculated) minimum pressure, hereinafter referred to as the "minimum system pressure." The minimum system pressure may be a minimum sea water pressure that has been determined to be necessary for operating some or all of a ship's sea water-operated systems, such as for cooling the engine and/or for supplying the systems 103-107. Alternatively, the minimum system pressure may be some arbitrary minimum value that is designated by an operator. In either case, during default operation of the system 10, the minimum system pressure may define an absolute lower limit for a ship's system pressure, and therefore an absolute lower limit on pump speed, regardless of how little sea water is contemporaneously required for cooling the ship's engine 11 or for supplying the other sea water-operated systems 103-107. The ship's system pressure is thereby kept "at the ready" in case a demand for sea water should suddenly arise. The ship's system pressure may be monitored by sensors that are integral with the ship and that are independent of the system 10, and may be communicated to the system 10 via a communications link.

Under certain circumstances, such as if the system 10 is operating in particularly cold waters and/or if the engine 11 is idling or operating at reduced speeds, the temperature of the fresh water in the fresh water cooling loop 14 may fall below the preferred operating range. This may occur despite the speed of the pumps 16 and 18 being reduced to a speed, hereinafter referred to as the "minimum pressure pump speed," that is only sufficient to maintain the above-described minimum system pressure. Such a situation may represent an inefficiency in the system 10, since the pumps 16 and 18 are being driven faster than is necessary to cool the engine 11 and/or to supply sea water to the other sea water-operated systems 103-107. Thus, in order to improve the efficiency of the system 10, it may be desirable to operate the system 10 in a "reduced pressure mode," wherein the system 10 operates the pumps 16 and 18 at reduced speeds and allows the speed of the pumps 16 and 18 to be reduced below the minimum pressure pump speed, and in some cases to be shut down completely.

A reduced pressure mode of the system 10 may be implemented in a variety of ways depending on the preferences of an operator and on the particular configuration and features of the system 10. For example, the manner in which a reduced pressure mode of the system 10 is implemented may vary depending on whether the system 10 is a 3×50% system or a 2×100% system. The manner of implementation may also depend on whether a system operator wishes to allow one or both of the pumps 16 and 18 of the system 10 to be completely shut down (hereinafter referred to as "pump stop authorization"). Still further, the manner of implementation may depend on whether the system 10 is equipped with, and if a system operator wishes to utilize, an "active valve control" (AVC) feature of the system 10, which will be described in greater detail below.

A number of non-limiting, exemplary methods for implementing various reduced pressure modes of the system 10 are set forth below and are depicted in the flow diagrams shown in FIGS. 3-10, all with respect to the system 10 shown in FIG. 1. These include a set of four modes of reduced pressure operation that may be implemented in a 3×50% system, and a similar set of four modes of reduced pressure operation that may be implemented in a 2×100% system. Each set includes a mode with no pump stop authorization and no AVC, a mode with pump stop authorization but no AVC, a mode with no pump stop authorization but with AVC, and a mode with pump stop authorization and with AVC. It is contemplated that a menu with options representing one or more of these modes may be presented to an operator, such as in an operator interface of the system 10, and that the operator may initiate one of the modes by selecting a corresponding option in the menu. Unless otherwise specified, the described methods may be performed wholly or in part by the controllers 28-32, such as through the execution of various software algorithms by the processors thereof.

Figure 3:
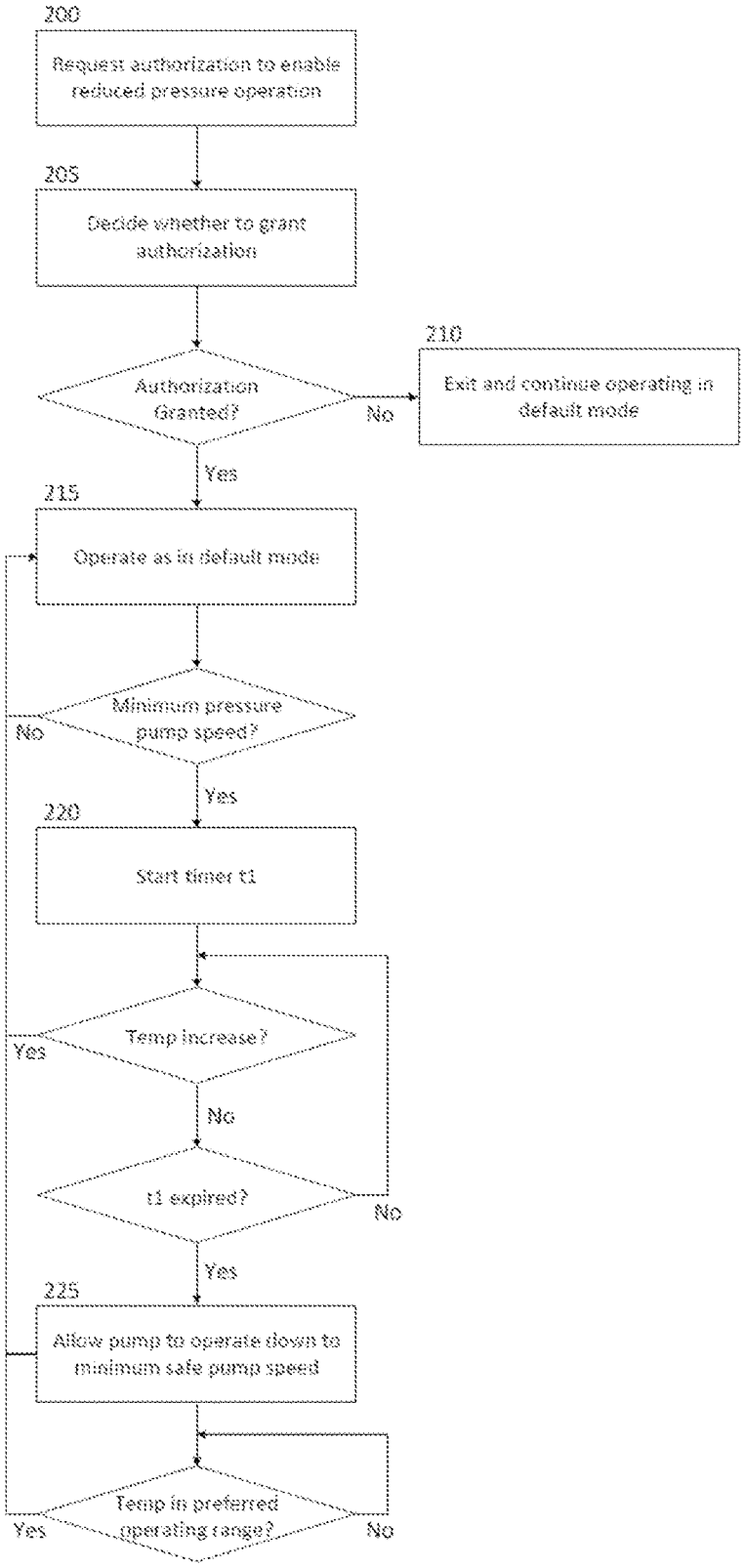
FIG. 3 is a flow diagram illustrating a first exemplary method for operating the intelligent sea water cooling system shown in FIG. 1 in a reduced pressure mode in accordance with the present disclosure.

Reduced Pressure Mode for 3×50% System with No Pump Shutdown and No Active Valve Control Referring to FIG. 3, a flow diagram illustrating a first exemplary method for implementing a reduced pressure mode of operation of the system 10 in accordance with the present disclosure is shown. This mode may be implemented in a 3×50% system (e.g., with each of the pumps 16 and 18 operating to provide 50% of the sea water pressure in the system 10) and may be selected if an operator does not wish to allow stoppage of the pumps 16 and 18 and if the system 10 is either not equipped with an AVC feature (described below) or if the operator does not wish to utilize AVC. Generally, this mode may allow a ship's system pressure to fall below the minimum system pressure if such a reduction is deemed necessary for raising the temperature of the fresh water in the fresh water cooling loop 14 back into the preferred operating range.

Upon selecting this mode of reduced pressure operation, the system 10 may, at step 200, send a message to the engine control room or other supervisory area of the ship requesting authorization to enable reduced pressure operation. Personnel in the engine control room may then decide, at step 205, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 210, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 215, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the pump 18 has been shut down and the speed of the pump 16 has been reduced to the minimum pressure pump speed, the system 10 may, at step 220 of the method, start a timer t1 having a predefined duration (e.g., 5 minutes).

If the temperature in the fresh water cooling loop 14 begins to increase before expiration of the timer t1, the system 10 may repeat step 215 of the method. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 225, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If, while the minimum safe pump speed is being used to dictate an absolute minimum speed of the pumps 16 and 18, the temperature in the fresh water cooling loop 14 increases and reenters the preferred operating range, the system 10 may repeat step 215 of the method. The system 10 may then operate substantially as in the default mode until the pump speed again drops to the minimum pressure pump speed, at which time the timer t1 will be reset and restarted.

By allowing the speed of the pump 16 to be decreased below the minimum pressure pump speed in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is not repeatedly shut down and restarted in order to regulate engine temperature as is the case in many conventional sea water cooling systems, the operational life of the pump 16 and related system components may be extended.

Figure 4:
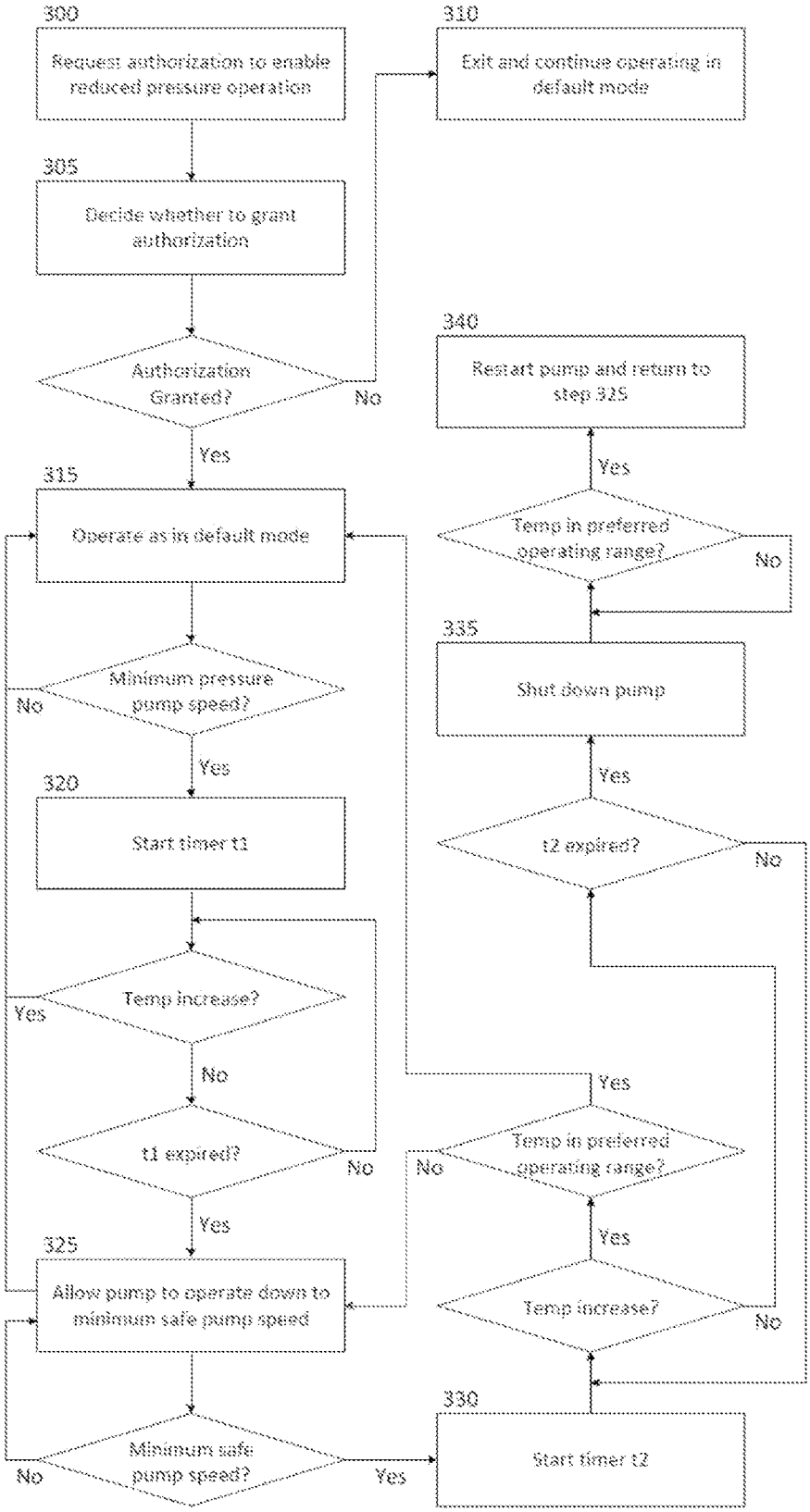
FIG. 4 is a flow diagram illustrating a second exemplary method for operating the intelligent sea water cooling system shown in FIG. 1 in a reduced pressure mode in accordance with the present disclosure.

Exemplary Reduced Pressure Mode for 3×50% System with Pump Shutdown but No Active Valve Control Referring to FIG. 4, a flow diagram illustrating a second exemplary method for implementing a reduced pressure mode of operation of the system 10 in accordance with the present disclosure is shown. This mode may be implemented in a 3×50% system (e.g., with each of the pumps 16 and 18 operating to provide 50% of the sea water pressure in the system 10) and may be selected if an operator wishes to authorize stoppage of the pumps 16 and 18 and if the system 10 is either not equipped with an AVC feature (described below) or if the operator does not wish to utilize AVC. Generally, this mode may allow a ship's system pressure to fall below the minimum system pressure, and may further allow one or both of the pumps 16 and 18 to be shut down, if such a reduction and/or shutdown is deemed necessary for raising the temperature of the fresh water in the fresh water cooling loop 14 back into the preferred operating range.

Upon selecting this mode of reduced pressure operation, the system 10 may, at step 300, send a message to the engine control room or other supervisory area of the ship requesting authorization to enable reduced pressure operation. Personnel in the engine control room may then decide, at step 305 of the method, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 310, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 315, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the pump 18 has been shut down and the speed of the remaining pump 16 has been reduced to the minimum pressure pump speed, the system 10 may, at step 320, start a timer t1 having a predefined duration (e.g., 5 minutes).

If the temperature in the fresh water cooling loop 14 begins to increase before expiration of the timer, the system 10 may repeat step 315. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 325, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If the speed of the pump 16 is reduced all the way down to the minimum safe pump speed in an effort to increase the temperature of the fresh water in the fresh water cooling loop 14, the system 10 may, at step 330, start a timer t2 having a predefined duration (e.g., 5 minutes).

If, before expiration of the timer t2, the temperature in the fresh water cooling loop 14 has increased but has not risen into the preferred operating range, the system 10 may repeat step 325, thereby operating in substantially the same manner as in the default mode until the pump speed again drops to the minimum safe pump speed, at which time the timer t2 will be reset and restarted. If, however, the temperature in the fresh water cooling loop 14 rises into the preferred operating range before expiration of the timer t2, the system 10 may repeat step 315, thereby operating in substantially the same manner as in the default mode until the pump speed again drops to the minimum pressure pump speed, at which time the timer t1 will be reset and restarted.

Alternatively, if the timer t2 expires and the temperature of the fresh water in the fresh water cooling loop 14 has not increased, the system 10 may, at step 335, shut down the remaining pump 16. The ship's system pressure may thereby be reduced further if such a reduction is necessary to facilitate an increase in the temperature of the fresh water in the fresh water cooling loop 14.

If, after shutting down the remaining operational pump 16 in step 335, the temperature in the fresh water cooling loop 14 increases and reenters the preferred operating range, the system 10 may, at step 340, restart the pump 16 and may repeat step 325, with the speed of the pump 16 initially being set to the speed at which it was set prior to being shut down. One-pump operation of the system 10 may thereby be reestablished until the temperature in the fresh water cooling loop 14 and/or the efficiency of the system 10 warrants restarting the pump 18 or again warrants shutting down the pump 16.

By allowing the speed of the pump 16 to be decreased below the minimum pressure pump speed and, if necessary, allowing the pump 16 to be shut down in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is allowed to operate at lower speeds relative to many conventional sea water cooling systems before being shut down, the frequency with which the pump 16 is shut down and restarted is comparatively reduced, thereby extending the operational life of the pump 16 and related system components.

Figure 5:
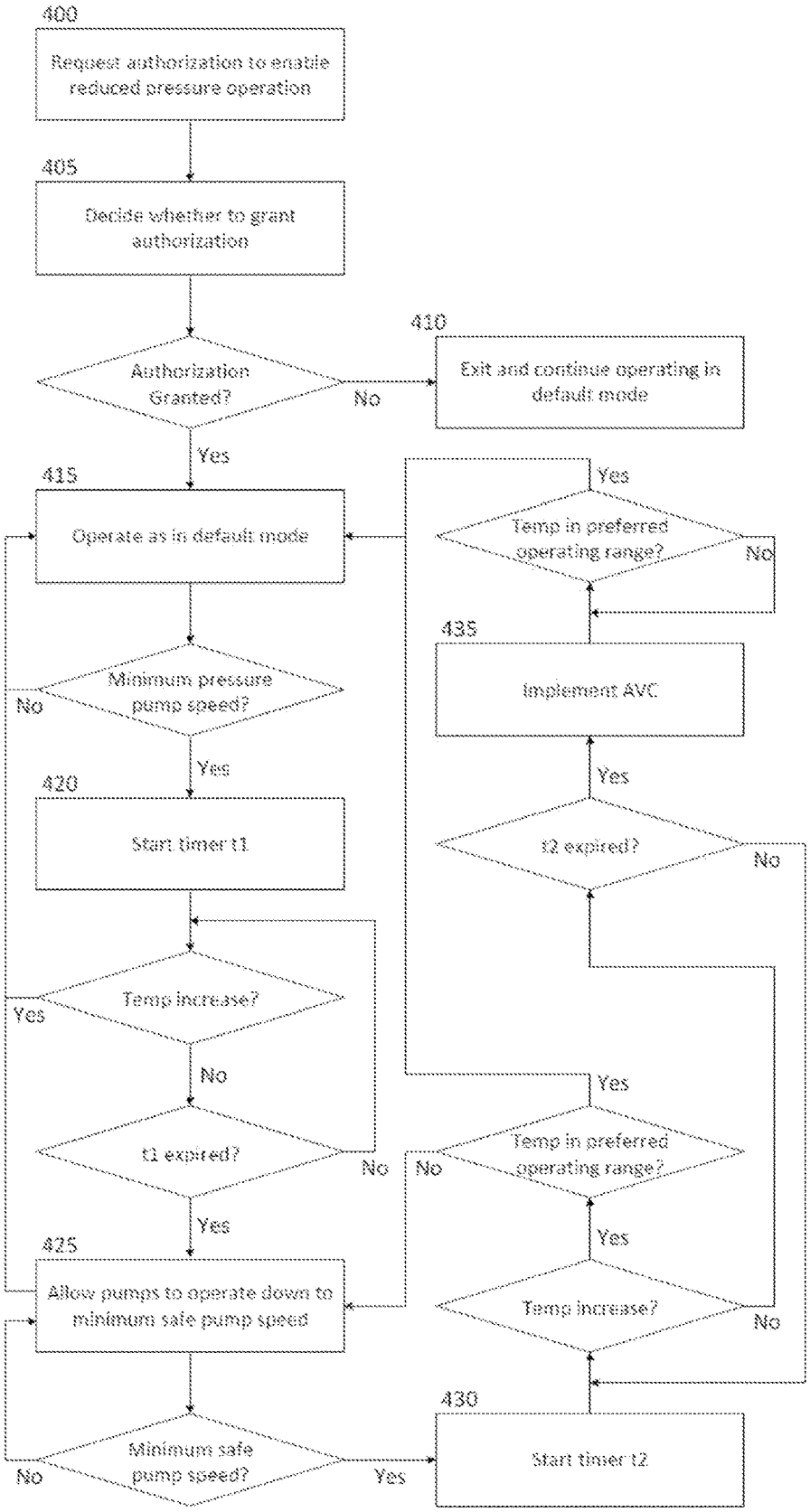
FIG. 5 is a flow diagram illustrating a third exemplary method for operating the intelligent sea water cooling system shown in FIG. 1 in a reduced pressure mode in accordance with the present disclosure.

Exemplary Reduced Pressure Mode for 3×50% System with Active Valve Control but No Pump Shutdown Referring to FIG. 5, a flow diagram illustrating a third exemplary method for implementing a reduced pressure mode of operation of the system 10 in accordance with the present disclosure is shown. This mode may be implemented in a 3×50% system (e.g., with each of the pumps 16 and 18 operating to provide 50% of the sea water pressure in the system 10) and may be selected if an operator does not wish to allow stoppage of the pumps 16 and 18 but does wish to utilize an AVC feature of the system 10 as further described below. Generally, this mode may allow the ship's system pressure to fall below the minimum system pressure if such a reduction is deemed necessary for raising the temperature of the fresh water in the fresh water cooling loop 14 back into the preferred operating range, and may also allow the discharge valve 89 of the system 10 to be partially closed in order to further reduce the flow of sea water through the system 10 without further reducing the speed of the pumps 16 and 18.

Upon selecting this mode of reduced pressure operation, the system 10 may, at step 400, send a message to the engine control room or other supervisory area of the ship requesting authorization to enable reduced pressure operation. Personnel in the engine control room may then decide, at step 405, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 410, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 415, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the pump 18 has been shut down and the speed of the remaining pump 16 has been reduced to the minimum pressure pump speed, the system 10 may, at step 420, start a timer t1 having a predefined duration (e.g., 5 minutes).

If the temperature in the fresh water cooling loop 14 begins to increase before expiration of the timer t1, the system 10 may repeat step 415. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 425, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If the speed of the pump 16 is reduced all the way down to the minimum safe pump speed in an effort to increase the temperature of the fresh water in the fresh water cooling loop 14, the system 10 may, at step 430, start a timer t2 having a predefined duration (e.g., 5 minutes).

If, before expiration of the timer t2, the temperature in the fresh water cooling loop 14 has increased but has not risen into the preferred operating range, the system 10 may repeat step 425, thereby operating in substantially the same manner as in the default mode until the pump speed again drops to the minimum safe pump speed, at which time the timer t2 will be reset and restarted. If, however, the temperature in the fresh water cooling loop 14 rises into the preferred operating range before expiration of the timer t2, the system 10 may repeat step 415, thereby operating in substantially the same manner as in the default mode until the pump speed again drops to the minimum pressure pump speed, at which time the timer t1 will be reset and restarted.

Alternatively, if the timer t2 expires and the temperature of the fresh water in the fresh water cooling loop 14 has not increased, the system 10 may, at step 435, implement AVC, whereby the discharge valve 89 may be manipulated to control the temperature of the fresh water in the fresh water cooling loop 14. For example, the discharge valve 89 may be incrementally closed to incrementally reduce/restrict the flow of sea water in the sea water cooling loop 12 of the system 10 without further reducing the operating speed of the pump 16. This reduction in the flow of sea water may result in reduced cooling of the fresh water in the fresh water cooling loop 14 via the heat exchanger 15. The temperature in the fresh water cooling loop 14 may thereby be stabilized or raised while the pump 16 continues to be operated at or above the minimum safe pump speed. Of course, it will be appreciated that there is a limit (hereinafter referred to as the "max close") to how far the discharge valve 89 may be allowed to close, since some amount of sea water must be allowed to flow through the system 10 while the pump 16 is operating. It will further be appreciated that the discharge valve 89 may also be incrementally opened in order to increase the flow of sea water in the sea water cooling loop 12, thereby increasing cooling in the fresh water cooling loop 14 via the heat exchanger 15.

If, after implementing AVC in step 435, the temperature in the fresh water cooling loop 14 increases and reenters the preferred operating range, the system 10 may repeat step 415. The system 10 may then operate substantially as in the default mode until the pump speed again drops to the minimum pressure pump speed, at which time the timer t1 will be reset and restarted.

By allowing the speed of the pump 16 to be decreased below the minimum pressure pump speed in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is not repeatedly shut down and restarted in order to regulate engine temperature as is the case in many conventional sea water cooling systems, the operational life of the pump 16 and related system components may be extended. Additionally, the AVC feature of the system 10 further improves the efficiency of the system 10 and prolongs the life of the pumps 16 and 18 by allowing the temperature of the fresh water in the fresh water cooling loop 14 to be controlled without operating or shutting down the pumps 16 and 18.

Figure 6:
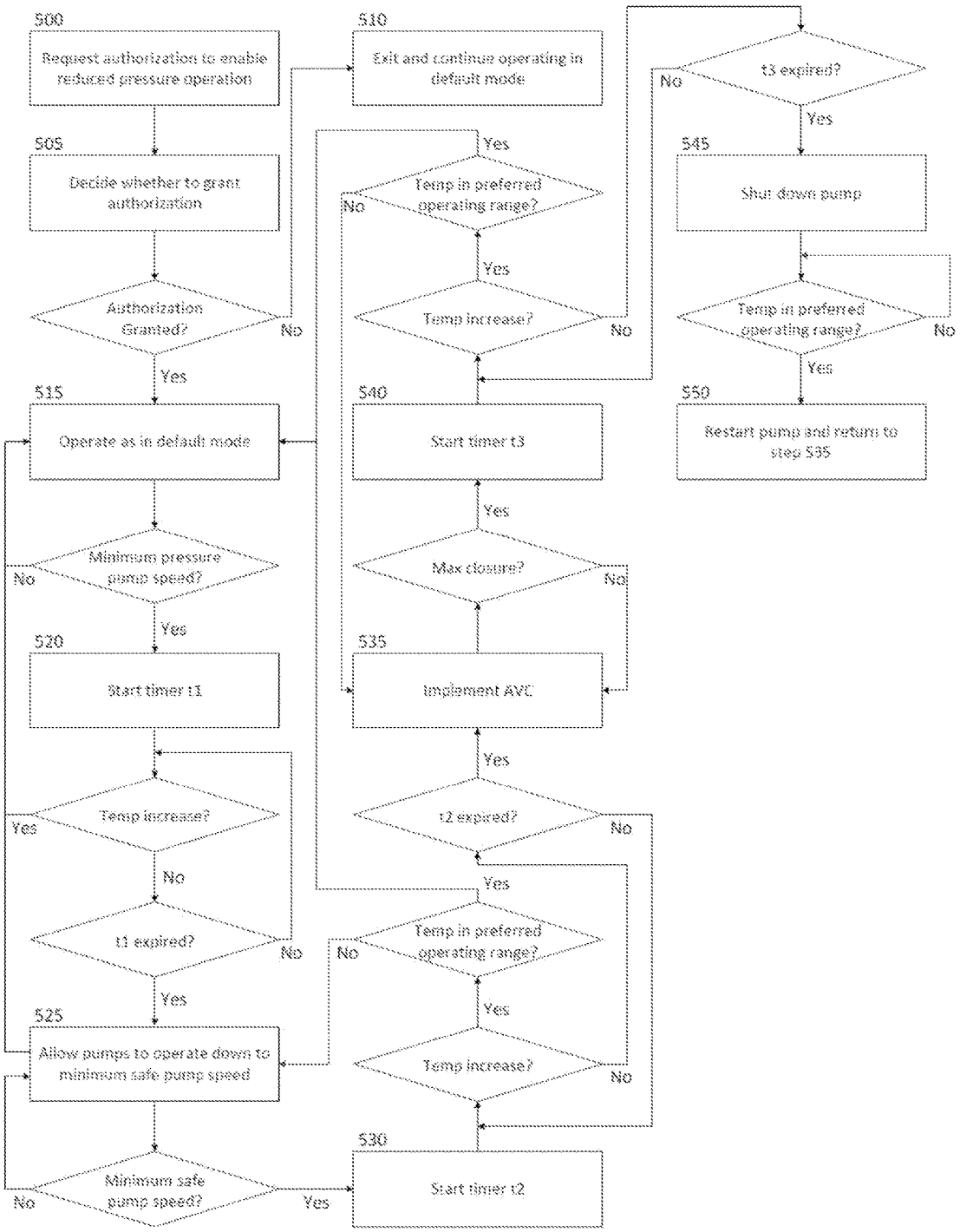
FIG. 6 is a flow diagram illustrating a fourth exemplary method for operating the intelligent sea water cooling system shown in FIG. 1 in a reduced pressure mode in accordance with the present disclosure.

Exemplary Reduced Pressure Mode for 3×50% System with Pump Shutdown and Active Valve Control Referring to FIG. 6, a flow diagram illustrating a fourth exemplary method for implementing a reduced pressure mode of operation of the system 10 in accordance with the present disclosure is shown. This mode may be implemented in a 3×50% system (e.g., with each of the pumps 16 and 18 operating to provide 50% of the sea water pressure in the system 10) and may be selected if an operator wishes to authorize stoppage of the pumps 16 and 18 and wishes to utilize an AVC feature of the system 10 as further described below. Generally, this mode may allow a ship's system pressure to fall below the minimum system pressure, may allow the discharge valve 89 of the system 10 to be partially closed in order to further reduce the flow of sea water through the system 10 without further reducing the speed of the pumps 16 and 18, and may further allow one or both of the pumps 16 and 18 to be shut down if deemed necessary for raising the temperature of the fresh water in the fresh water cooling loop 14 back into the preferred operating range.

Upon selecting this mode of reduced pressure operation, the system 10 may, at step 500, send a message to the engine control room or other supervisory area of the ship requesting authorization to enable reduced pressure operation. Personnel in the engine control room may then decide, at step 505, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 510, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 515, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the pump 18 has been shut down and the speed of the remaining pump 16 has been reduced to the minimum pressure pump speed, the system 10 may, at step 520, start a timer t1 having a predefined duration (e.g., 5 minutes).

If the temperature in the fresh water cooling loop 14 begins to increase before expiration of the timer, the system 10 may repeat step 515. The system 10 may thereby continue to operate in substantially the same manner as in the default mode until the pump speed again drops to the minimum pressure pump speed, at which time the timer t1 may be reset and restarted.

Alternatively, if the timer t1 expires and the temperature of the fresh water in the fresh water cooling loop 14 has not increased, the system 10 may, at step 525, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If the speed of the pump 16 is reduced all the way down to the minimum safe pump speed in an effort to increase the temperature of the fresh water in the fresh water cooling loop 14, the system 10 may, at step 530, start a timer t2 having a predefined duration (e.g., 5 minutes).

If, before expiration of the timer t2, the temperature in the fresh water cooling loop 14 has increased but has not risen into the preferred operating range, the system 10 may repeat step 525, thereby operating in substantially the same manner as in the default mode until the pump speed again drops to the minimum safe pump speed, at which time the timer t2 will be reset and restarted. If, however, the temperature in the fresh water cooling loop 14 rises into the preferred operating range before expiration of the timer t2, the system 10 may repeat step 515, thereby operating in substantially the same manner as in the default mode until the pump speed again drops to the minimum pressure pump speed, at which time the timer t1 will be reset and restarted.

Alternatively, if the timer t2 expires and the temperature of the fresh water in the fresh water cooling loop 14 has not increased, the system 10 may, at step 535, initiate AVC, whereby the discharge valve 89 may be manipulated to control the temperature of the fresh water in the fresh water cooling loop 14. For example, the discharge valve 89 may be incrementally closed to incrementally reduce/restrict the flow of sea water in the sea water cooling loop 12 of the system 10 without further reducing the operating speed of the pump 16. This reduction in the flow of sea water may result in reduced cooling of the fresh water in the fresh water cooling loop 14 via the heat exchanger 15. The temperature in the fresh water cooling loop 14 may thereby be stabilized or raised while the pump 16 continues to be operated at or above the minimum safe pump speed. Of course, it will be appreciated that there is a limit (hereinafter referred to as the "max closure") to how far the discharge valve 89 may be allowed to close, since some amount of sea water must be allowed to flow through the system 10 while the pump 16 is operating. It will further be appreciated that the discharge valve 89 may also be incrementally opened in order to increase the flow of sea water in the sea water cooling loop 12, thereby increasing cooling in the fresh water cooling loop 14 via the heat exchanger 15.

If, during the implementation of AVC, the discharge valve 89 is closed to the max closure in an effort to increase the temperature of the fresh water in the fresh water cooling loop 14, the system 10 may, at step 540, start a timer t3 having a predefined duration (e.g., 5 minutes).

If, before expiration of the timer t3, the temperature in the fresh water cooling loop 14 has increased but has not risen into the preferred operating range, the system 10 may repeat step 535, thereby continuing to operate with AVC until the discharge valve 89 is again closed to the max closure, at which time the timer t3 will be reset and restarted. If, however, the temperature in the fresh water cooling loop 14 rises into the preferred operating range before expiration of the timer t3, the system 10 may repeat step 515, thereby operating in substantially the same manner as in the default mode until the pump speed again drops to the minimum pressure pump speed, at which time the timer t1 will be reset and restarted.

Alternatively, if the timer t3 expires and the temperature of the fresh water in the fresh water cooling loop 14 has not increased, the system 10 may, at step 545, shut down the remaining operating pump 16 entirely. The ship's system pressure may thereby be reduced further if such a reduction is necessary to facilitate an increase in the temperature of the fresh water in the fresh water cooling loop 14.

If, after shutting down the remaining operational pump 16 in step 545, the temperature in the fresh water cooling loop 14 increases and reenters the preferred operating range, the system 10 may, at step 550, restart the pump 16 and may repeat step 535, with the speed of the pump 16 initially being set to the speed at which it was set to prior to being shut down. One-pump operation of the system 10 with AVC may thereby be reestablished until the temperature in the fresh water cooling loop 14 and/or the efficiency of the system 10 warrants restarting the pump 18 or again warrants shutting down the pump 16.

By allowing the speed of the pump 16 to be decreased below the minimum pressure pump speed and, if necessary, allowing the pump 16 to be shut down in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is allowed to operate at lower speeds relative to many conventional sea water cooling systems before the pump 16 is shut down, the frequency with which the pump 16 is shut down and restarted is comparatively reduced, thereby extending the operational life of the pump 16 and related system components. Additionally, the AVC feature of the system 10 further improves the efficiency of the system 10 and prolongs the life of the pumps 16 and 18 by allowing the temperature of the fresh water in the fresh water cooling loop 14 to be controlled without operating or shutting down the pumps 16 and 18.

Figure 7:
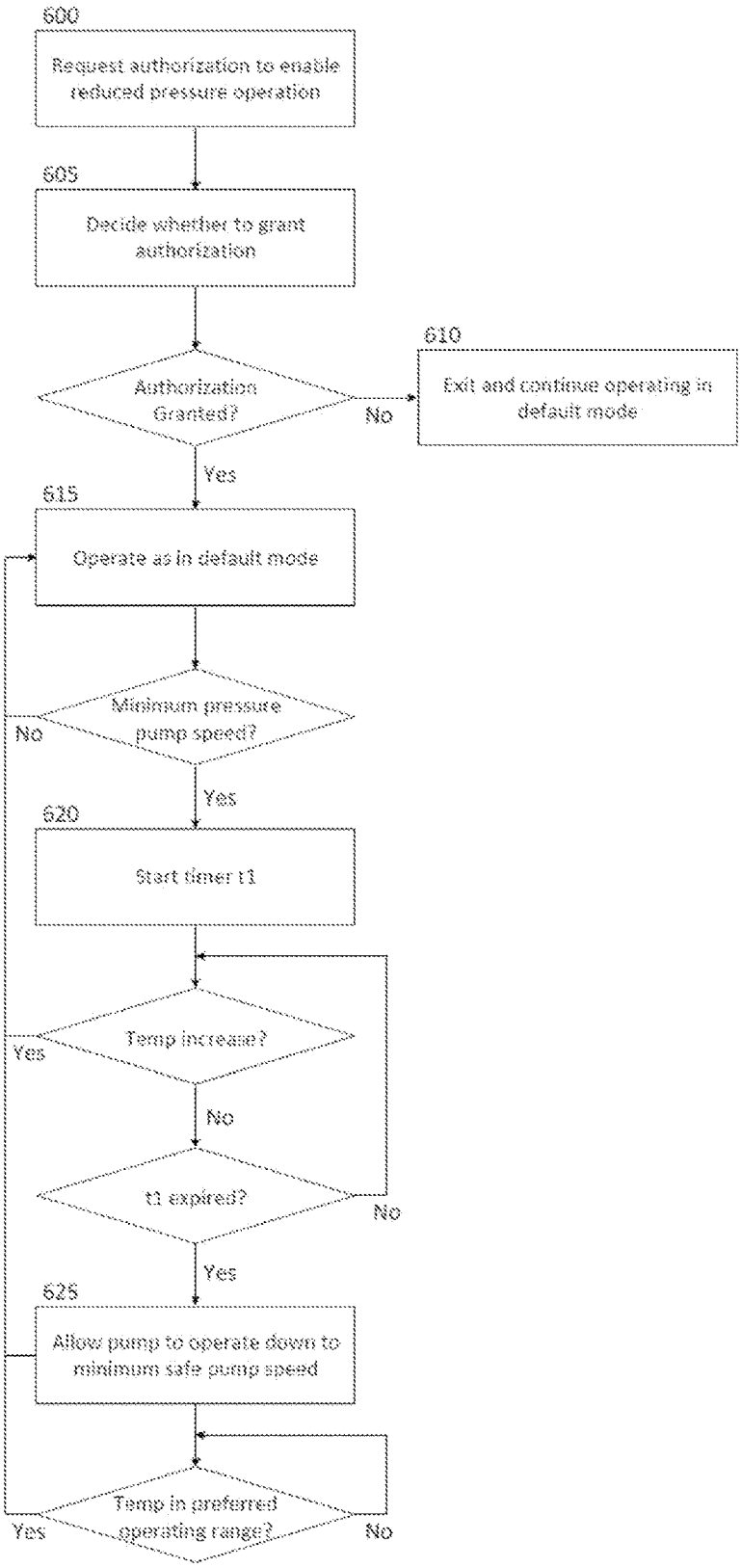
FIG. 7 is a flow diagram illustrating a fifth exemplary method for operating the intelligent sea water cooling system shown in FIG. 1 in a reduced pressure mode in accordance with the present disclosure.

Exemplary Reduced Pressure Mode for 2×100% System with No Pump Shutdown and No Active Valve Control Referring to FIG. 7 a flow diagram illustrating a fifth exemplary method for implementing a reduced pressure mode of operation of the system 10 in accordance with the present disclosure is shown. This mode may be implemented in a 2×100% system (e.g., with only the pump 16 operating to provide 100% of the sea water pressure in the system 10) and may be selected if an operator does not wish to allow stoppage of the pump 16 and if the system 10 is either not equipped with an AVC feature (described below) or if the operator does not wish to utilize AVC. Generally, this mode may allow a ship's system pressure to fall below the minimum system pressure if such a reduction is deemed necessary for raising the temperature of the fresh water in the fresh water cooling loop 14 back into the preferred operating range.

Upon selecting this mode of reduced pressure operation, the system 10 may, at step 600 of the exemplary method, send a message to the engine control room or other supervisory area of the ship requesting authorization to enable reduced pressure operation. Personnel in the engine control room may then decide, at step 605, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 610, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 615, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the speed of the pump 16 has been reduced to the minimum pressure pump speed, the system 10 may, at step 620, start a timer t1 having a predefined duration (e.g., 5 minutes).

If the temperature in the fresh water cooling loop 14 begins to increase before expiration of the timer t1, the system 10 may repeat step 615. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 625, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If, while the minimum safe pump speed is being used to dictate an absolute minimum speed of the pump 16, the temperature in the fresh water cooling loop 14 increases and reenters the preferred operating range, the system 10 may repeat step 615. The system 10 may then operate substantially as in the default mode until the pump speed again drops to the minimum pressure pump speed, at which time the timer t1 will be reset and restarted.

By allowing the speed of the pump 16 to be decreased below the minimum pressure pump speed in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is not repeatedly shut down and restarted in order to regulate engine temperature as is the case in many conventional sea water cooling systems, the operational life of the pump 16 and related system components may be extended.

Figure 8:
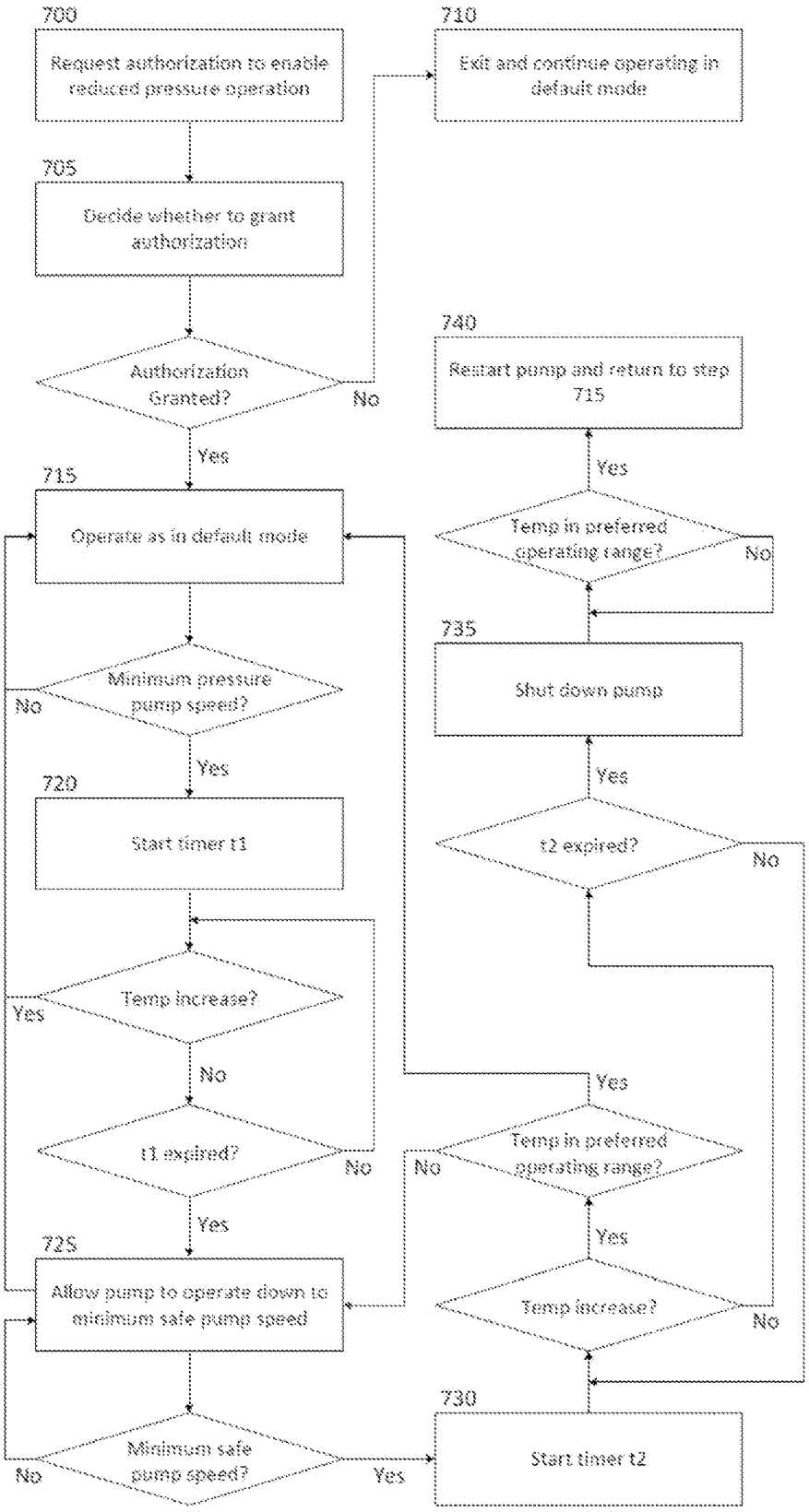
FIG. 8 is a flow diagram illustrating a sixth exemplary method for operating the intelligent sea water cooling system shown in FIG. 1 in a reduced pressure mode in accordance with the present disclosure.

Exemplary Reduced Pressure Mode for 2×100% System with Pump Shutdown but No Active Valve Control Referring to FIG. 8, a flow diagram illustrating a sixth exemplary method for implementing a reduced pressure mode of operation of the system 10 in accordance with the present disclosure is shown. This mode may be implemented in a 2×100% system (e.g., with only the pump 16 operating to provide 100% of the sea water pressure in the system 10) and may be selected if an operator wishes to authorize stoppage of the pump 16 and if the system 10 is either not equipped with an AVC feature (described below) or if the operator does not wish to utilize AVC. Generally, this mode may allow a ship's system pressure to fall below the minimum system pressure, and may further allow the pump 16 shut down, if such a reduction and/or shutdown is deemed necessary for raising the temperature of the fresh water in the fresh water cooling loop 14 back into the preferred operating range.

Upon selecting this mode of reduced pressure operation, the system 10 may, at step 700, send a message to the engine control room or other supervisory area of the ship requesting authorization to enable reduced pressure operation. Personnel in the engine control room may then decide, at step 705, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 310, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 715, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the speed of the pump 16 has been reduced to the minimum pressure pump speed, the system 10 may, at step 720, start a timer t1 having a predefined duration (e.g., 5 minutes).

If the temperature in the fresh water cooling loop 14 begins to increase before expiration of the timer, the system 10 may repeat step 715. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 725, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If the speed of the pump 16 is reduced all the way down to the minimum safe pump speed in an effort to increase the temperature of the fresh water in the fresh water cooling loop 14, the system 10 may, at step 730, start a timer t2 having a predefined duration (e.g., 5 minutes).

If, before expiration of the timer t2, the temperature in the fresh water cooling loop 14 has increased but has not risen into the preferred operating range, the system 10 may repeat step 725, thereby operating in substantially the same manner as in the default mode until the pump speed again drops to the minimum safe pump speed, at which time the timer t2 will be reset and restarted. If, however, the temperature in the fresh water cooling loop 14 rises into the preferred operating range before expiration of the timer t2, the system 10 may repeat step 715, thereby operating in substantially the same manner as in the default mode until the pump speed again drops to the minimum pressure pump speed, at which time the timer t1 will be reset and restarted.

Alternatively, if the timer t2 expires and the temperature of the fresh water in the fresh water cooling loop 14 has not increased, the system 10 may, at step 735, shut down the pump 16 entirely. The ship's system pressure may thereby be reduced further (i.e., relative to one-pump operation) if such a reduction is necessary to facilitate an increase in the temperature of the fresh water in the fresh water cooling loop 14.

If, after shutting down the pump 16, the temperature in the fresh water cooling loop 14 increases and reenters the preferred operating range, the system 10 may, at step 740, restart the pump 16 and may repeat step 715. One-pump operation of the system 10 may thereby be reestablished and the system 10 may operate in substantially the same manner as in the default mode until the pump speed again drops to the minimum pressure pump speed, at which time the timer t1 will be reset and restarted.

By allowing the speed of the pump 16 to be decreased below the minimum pressure pump speed and, if necessary, allowing the pump 16 to be shut down in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is allowed to operate at lower speeds relative to many conventional sea water cooling systems before the pump 16 is shut down, the frequency with which the pump 16 is shut down and restarted is comparatively reduced, thereby extending the operational life of the pump 16 and related system components.

Figure 9:
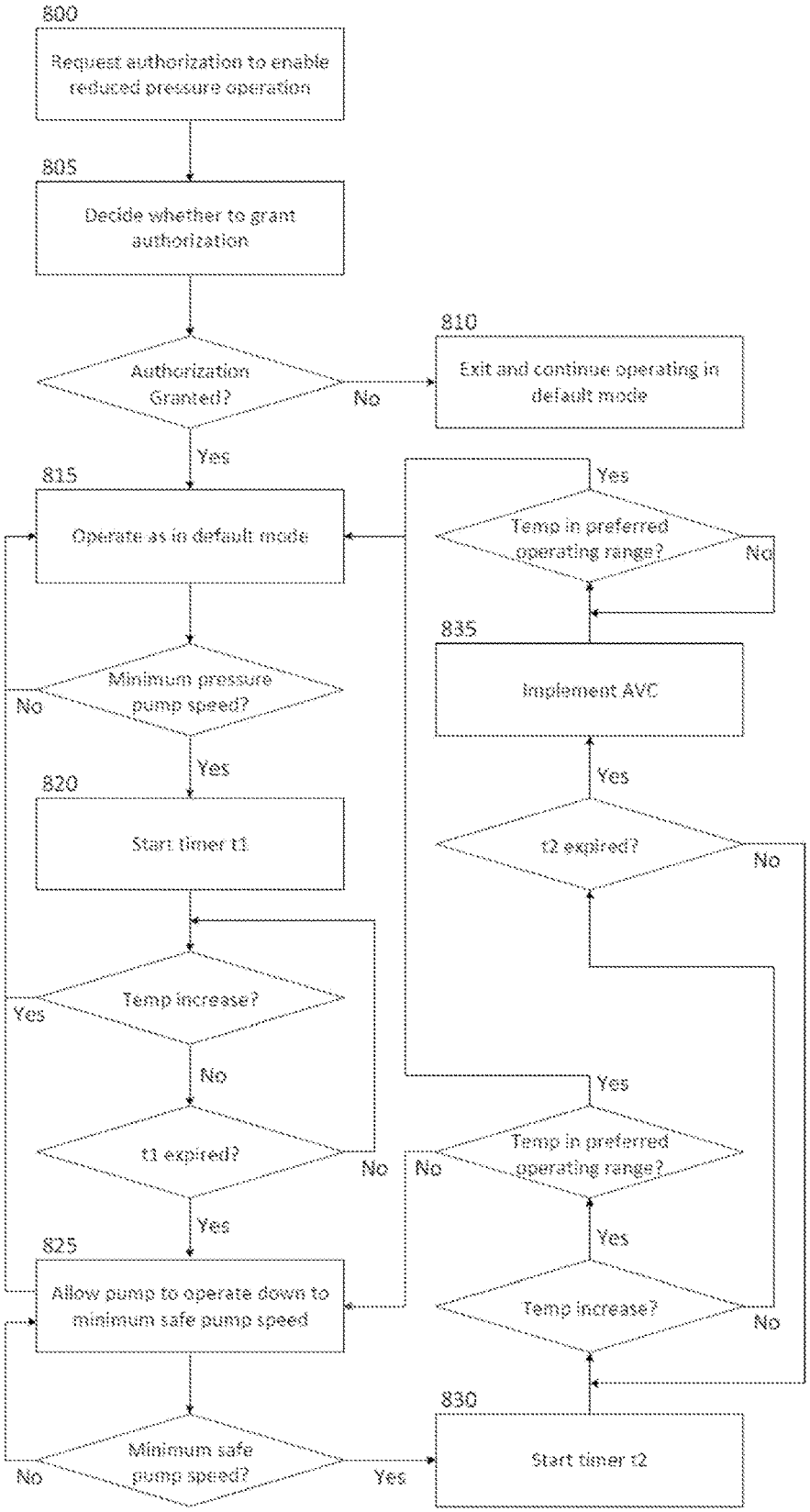
FIG. 9 is a flow diagram illustrating a seventh exemplary method for operating the intelligent sea water cooling system shown in FIG. 1 in a reduced pressure mode in accordance with the present disclosure.

Exemplary Reduced Pressure Mode for 2×100% System with Active Valve Control but No Pump Shutdown Referring to FIG. 9, a flow diagram illustrating a seventh exemplary method for implementing a reduced pressure mode of operation of the system 10 in accordance with the present disclosure is shown. This mode may be implemented in a 2×100% system (e.g., with only the pump 16 operating to provide 100% of the sea water pressure in the system 10) and may be selected if an operator does not wish to allow stoppage of the pump 16 but does wish to utilize an AVC feature of the system 10 as further described below. Generally, this mode may allow the ship's system pressure to fall below the minimum system pressure if such a reduction is deemed necessary for raising the temperature of the fresh water in the fresh water cooling loop 14 back into the preferred operating range, and may also allow the discharge valve 89 of the system 10 to be partially closed in order to further reduce the flow of sea water through the system 10 without further reducing the speed of the pump 16.

Upon selecting this mode of reduced pressure operation, the system 10 may, at step 800, send a message to the engine control room or other supervisory area of the ship requesting authorization to enable reduced pressure operation. Personnel in the engine control room may then decide, at step 805, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 810, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 815, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the speed of the pump 16 has been reduced to the minimum pressure pump speed, the system 10 may, at step 820, start a timer t1 having a predefined duration (e.g., 5 minutes).

If the temperature in the fresh water cooling loop 14 begins to increase before expiration of the timer t1, the system 10 may repeat step 815. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 825, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If the speed of the pump 16 is reduced all the way down to the minimum safe pump speed in an effort to increase the temperature of the fresh water in the fresh water cooling loop 14, the system 10 may, at step 830, start a timer t2 having a predefined duration (e.g., 5 minutes).

If, before expiration of the timer t2, the temperature in the fresh water cooling loop 14 has increased but has not risen into the preferred operating range, the system 10 may repeat step 825, thereby operating in substantially the same manner as in the default mode until the pump speed again drops to the minimum safe pump speed, at which time the timer t2 will be reset and restarted. If, however, the temperature in the fresh water cooling loop 14 rises into the preferred operating range before expiration of the timer t2, the system 10 may repeat step 815, thereby operating in substantially the same manner as in the default mode until the pump speed again drops to the minimum pressure pump speed, at which time the timer t1 will be reset and restarted.

Alternatively, if the timer t2 expires and the temperature of the fresh water in the fresh water cooling loop 14 has not increased, the system 10 may, at step 835 of the exemplary method, implement AVC, whereby the discharge valve 89 may be manipulated to control the temperature of the fresh water in the fresh water cooling loop 14. For example, the discharge valve 89 may be incrementally closed to incrementally reduce/restrict the flow of sea water in the sea water cooling loop 12 of the system 10 without further reducing the operating speed of the pump 16. This reduction in the flow of sea water may result in reduced cooling of the fresh water in the fresh water cooling loop 14 via the heat exchanger 15. The temperature in the fresh water cooling loop 14 may thereby be stabilized or raised while the pump 16 continues to be operated at or above the minimum safe pump speed. Of course, it will be appreciated that there is a limit (hereinafter referred to as the "max close") to how far the discharge valve 89 may be allowed to close, since some amount of sea water must be allowed to flow through the system 10 while the pump 16 is operating. It will further be appreciated that the discharge valve 89 may also be incrementally opened in order to increase the flow of sea water in the sea water cooling loop 12, thereby increasing cooling in the fresh water cooling loop 14 via the heat exchanger 15.

If, after AVC is implemented in step 835, the temperature in the fresh water cooling loop 14 increases and reenters the preferred operating range, the system 10 may repeat step 815 of the method. The system 10 may then operate substantially as in the default mode until the pump speed again drops to the minimum pressure pump speed, at which time the timer t1 will be reset and restarted.

By allowing the speed of the pump 16 to be decreased below the minimum pressure pump speed in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is not repeatedly shut down and restarted in order to regulate engine temperature as is the case in many conventional sea water cooling systems, the operational life of the pump 16 and related system components may be extended. Additionally, the AVC feature of the system 10 further improves the efficiency of the system 10 and prolongs the life of the pump 16 by allowing the temperature of the fresh water in the fresh water cooling loop 14 to be controlled without operating or shutting down the pump 16.

Figure 10:
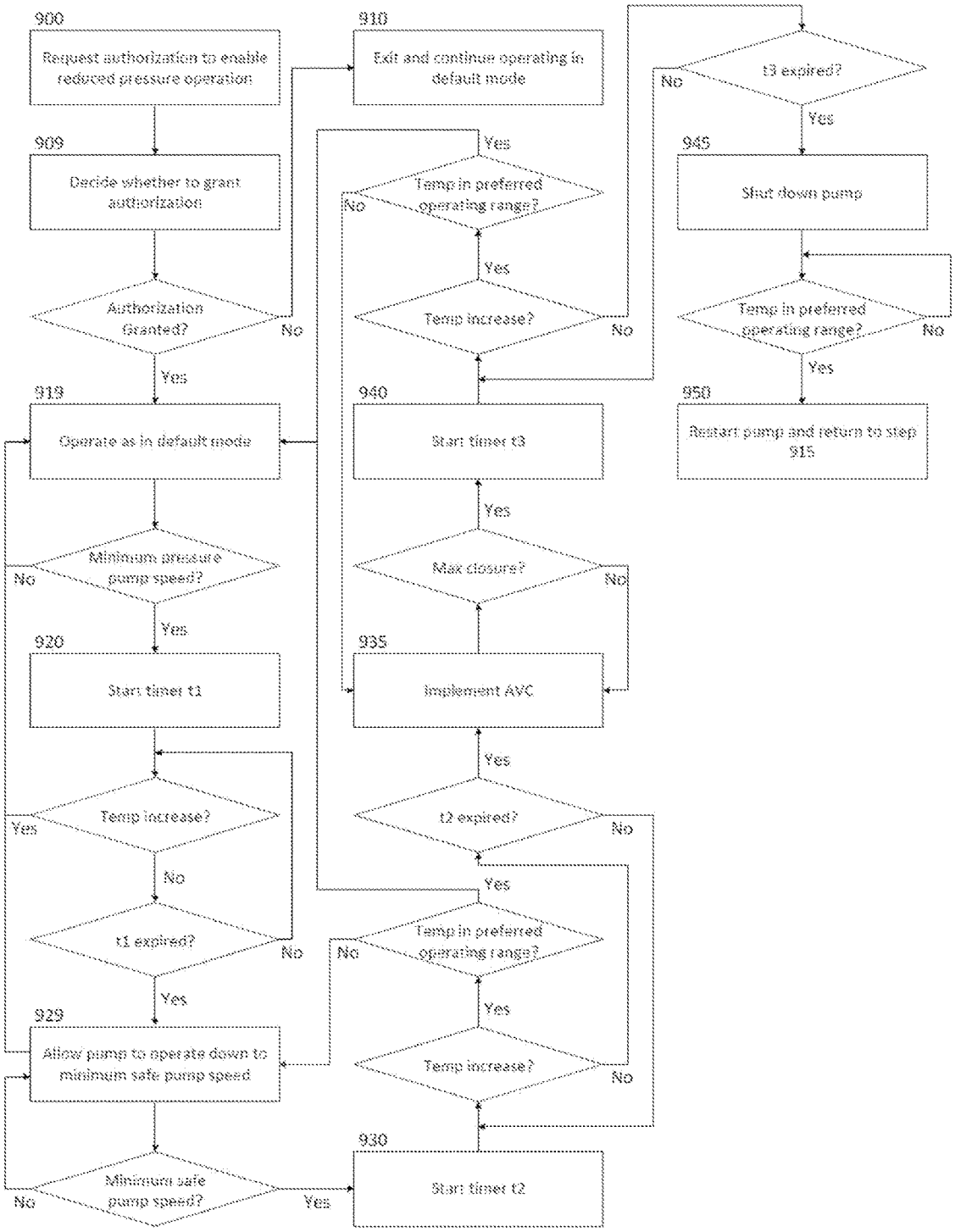
FIG. 10 is a flow diagram illustrating an eighth exemplary method for operating the intelligent sea water cooling system shown in FIG. 1 in a reduced pressure mode in accordance with the present disclosure.

Exemplary Reduced Pressure Mode for 2×100% System with Pump Shutdown and Active Valve Control Referring to FIG. 10, a flow diagram illustrating an eighth exemplary method for implementing a reduced pressure mode of operation of the system 10 in accordance with the present disclosure is shown. This mode may be implemented in a 2×100% system (e.g., with only the pump 16 operating to provide 100% of the sea water pressure in the system 10) and may be selected if an operator wishes to authorize stoppage of the pump 16 and wishes to utilize an AVC feature of the system 10 as further described below. Generally, this mode may allow a ship's system pressure to fall below the minimum system pressure, may allow the discharge valve 89 of the system 10 to be partially closed in order to further reduce the flow of sea water through the system 10 without further reducing the speed of the pump 16, and may further allow the pump 16 to be shut down if deemed necessary for raising the temperature of the fresh water in the fresh water cooling loop 14 back into the preferred operating range.

Upon selecting this mode of reduced pressure operation, the system 10 may, at step 900, send a message to the engine control room or other supervisory area of the ship requesting authorization to enable reduced pressure operation. Personnel in the engine control room may then decide, at step 905, whether to provide such authorization based on a variety of considerations. These considerations may include, but are not limited to, whether the personnel foresee a near term demand for sea water in the system 10, such as for cooling the engine 11 or for supplying one or more of the ship's sea water-operated systems 103-107.

If the personnel in the engine control room deny authorization to enable reduced pressure operation, the system 10 may, at step 910, be prevented from initiating the reduced pressure mode, and may continue operating in accordance with the default operating mode as described above, wherein the minimum system pressure is maintained as an absolute lower limit for dictating pump speed.

Alternatively, if personnel in the engine control room provide authorization to enable reduced pressure operation of the system 10, the system 10 may, at step 915, proceed to operate in substantially the same manner as the default operating mode described above, but without maintaining the minimum system pressure as an absolute lower limit for dictating pump speed. Particularly, if the temperature of the fresh water in the fresh water cooling loop 14 has fallen below the preferred operating range, and, in response to such a temperature decrease, the speed of the pump 16 has been reduced to the minimum pressure pump speed, the system 10 may, at step 920, start a timer t1 having a predefined duration (e.g., 5 minutes).

If the temperature in the fresh water cooling loop 14 begins to increase before expiration of the timer, the system 10 may repeat step 915. The system 10 may thereby continue to operate in substantially the same manner as in the default mode until the pump speed again drops to the minimum pressure pump speed, at which time the timer t1 will be reset and restarted.

Alternatively, if the timer t1 expires and the temperature of the fresh water in the fresh water cooling loop 14 has not increased, the system 10 may, at step 925, allow the speed of the pump 16 to be reduced below the minimum pressure pump speed if necessary. Thus, the minimum system pressure is no longer used by the system 10 to dictate an absolute minimum speed of the pump 16. Instead, the system 10 may allow the speed of the pump 16 to be reduced further, down to a predefined "minimum safe pump speed," if such a reduction is necessary to facilitate an increase in the temperature of the fresh water in the fresh water cooling loop 14. The "minimum safe pump speed" may be a speed below which the pump 16 may be at risk of failure (e.g., cavitation), or may be some other predefined minimum speed that is below the minimum pressure pump speed. The system 10 may thereby operate in substantially the same manner as in the default mode, but with the minimum safe pump speed being used to dictate an absolute minimum speed of the pump 16 regardless of how little sea water is contemporaneously required for cooling the ship's engine 11 or for supplying the other sea water-operated systems 103-107.

If the speed of the pump 16 is reduced all the way down to the minimum safe pump speed in an effort to increase the temperature of the fresh water in the fresh water cooling loop 14, the system 10 may, at step 930, start a timer t2 having a predefined duration (e.g., 5 minutes).

If, before expiration of the timer t2, the temperature in the fresh water cooling loop 14 has increased but has not risen into the preferred operating range, the system 10 may repeat step 925, thereby operating in substantially the same manner as in the default mode until the pump speed again drops to the minimum safe pump speed, at which time the timer t2 will be reset and restarted. If, however, the temperature in the fresh water cooling loop 14 rises into the preferred operating range before expiration of the timer t2, the system 10 may repeat step 915, thereby operating in substantially the same manner as in the default mode until the pump speed again drops to the minimum pressure pump speed, at which time the timer t1 will be reset and restarted.

Alternatively, if the timer t2 expires and the temperature of the fresh water in the fresh water cooling loop 14 has not increased, the system 10 may, at step 935, initiate AVC, whereby the discharge valve 89 may be manipulated to control the temperature of the fresh water in the fresh water cooling loop 14. For example, the discharge valve 89 may be incrementally closed to incrementally reduce/restrict the flow of sea water in the sea water cooling loop 12 of the system 10 without further reducing the operating speed of the pump 16. This reduction in the flow of sea water may result in reduced cooling of the fresh water in the fresh water cooling loop 14 via the heat exchanger 15. The temperature in the fresh water cooling loop 14 may thereby be stabilized or raised while the pump 16 continues to be operated at or above the minimum safe pump speed. Of course, it will be appreciated that there is a limit (hereinafter referred to as the "max closure") to how far the discharge valve 89 may be allowed to close, since some amount of sea water must be allowed to flow through the system 10 while the pump 16 is operating. It will further be appreciated that the discharge valve 89 may also be incrementally opened in order to increase the flow of sea water in the sea water cooling loop 12, thereby increasing cooling in the fresh water cooling loop 14 via the heat exchanger 15.

If, during the implementation of AVC, the discharge valve 89 is closed to the max closure in an effort to increase the temperature of the fresh water in the fresh water cooling loop 14, the system 10 may, at step 940, start a timer t3 having a predefined duration (e.g., 5 minutes).

If, before expiration of the timer t3, the temperature in the fresh water cooling loop 14 has increased but has not risen into the preferred operating range, the system 10 may repeat step 935, thereby continuing to operate with AVC until the discharge valve 89 is again closed to the max closure, at which time the timer t3 will be reset and restarted. If, however, the temperature in the fresh water cooling loop 14 rises into the preferred operating range before expiration of the timer t3, the system 10 may repeat step 915, thereby operating in substantially the same manner as in the default mode until the pump speed again drops to the minimum pressure pump speed, at which time the timer t1 will be reset and restarted.

Alternatively, if the timer t3 expires and the temperature of the fresh water in the fresh water cooling loop 14 has not increased, the system 10 may, at step 945, shut down the pump 16 entirely. The ship's system pressure may thereby be reduced further (i.e., relative to one-pump operation) if such a reduction is necessary to facilitate an increase in the temperature of the fresh water in the fresh water cooling loop 14.

If, after shutting down the pump 16 in step 945, the temperature in the fresh water cooling loop 14 increases and reenters the preferred operating range, the system 10 may, at step 950, restart the pump 16 and may repeat step 915. One-pump operation of the system 10 may thereby be reestablished and the system 10 may operate in substantially the same manner as in the default mode until the pump speed again drops to the minimum pressure pump speed, at which time the timer t1 will be reset and restarted.

By allowing the speed of the pump 16 to be decreased below the minimum pressure pump speed and, if necessary, allowing the pump 16 to be shut down in the manner described above, the efficiency of the system 10 may be improved relative to the default operating mode because it is less likely that the pump 16 will be driven faster than is necessary to cool the engine 11 and/or to supply sea water to the other sea water-operated systems 103-107. Furthermore, since the pump 16 is allowed to operate at lower speeds relative to many conventional sea water cooling systems before the pump 16 is shut down, the frequency with which the pump 16 is shut down and restarted is comparatively reduced, thereby extending the operational life of the pump 16 and related system components. Additionally, the AVC feature of the system 10 further improves the efficiency of the system 10 and prolongs the life of the pump 16 by allowing the temperature of the fresh water in the fresh water cooling loop 14 to be controlled without operating or shutting down the pump 16.

As used herein, the terms "computer" and "controller" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definitions and/or meanings of the terms "computer" and "controller."

The "computers" and/or "controllers" described above may execute a set of instructions that are stored in one or more storage elements, in order to process input data. The storage elements may also store data or other information as desired or needed. The storage elements may be implemented as an information source or a physical memory element within the processing machine.

The set of instructions may include various commands that instruct the above-described computers and/or controllers as processing machines to perform specific operations such as the methods and processes of the various embodiments of the present disclosure. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. An intelligent sea water cooling system comprising a first fluid cooling loop coupled to a first side of a heat exchanger and to a thermal load, a second fluid cooling loop coupled to a second side of the heat exchanger, a pump configured to circulate fluid through the second fluid cooling loop, and a controller operatively connected to the pump, wherein the controller is configured to:

monitor a temperature in the first fluid cooling loop and adjust a speed of the pump to keep the temperature within a preferred operating range;

if the speed of the pump is reduced to a predefined minimum pressure pump speed, start a timer t1 having a predefined duration; and if the timer t1 expires and the temperature has not increased relative to when the timer t1 was started, reduce the speed of the pump below the minimum pressure pump speed.

2. The intelligent sea water cooling system of claim 1, wherein, if the speed of the pump is reduced below the minimum pressure pump speed, the controller is further configured to prevent the speed of the pump from being reduced below a predefined minimum safe pump speed.

3. The intelligent sea water cooling system of claim 2, wherein, if the speed of the pump is reduced to the minimum safe pump speed, the controller is further configured to:

start a timer t2 having a predefined duration; and if the timer t2 expires and the temperature has not increased relative to when the timer t2 was started, shut down the pump.

4. The intelligent sea water cooling system of claim 3, wherein, if the pump is shut down and the temperature rises into the preferred operating range, the controller is further configured to restart the pump.

5. The intelligent sea water cooling system of claim 3, wherein the pump is a first pump and the intelligent sea water cooling system further comprises a second pump configured to circulate fluid through the second fluid cooling loop, and wherein the controller is further configured to shut down the second pump if it is determined that one-pump operation is more efficient than two-pump operation.

6. The intelligent sea water cooling system of claim 3, wherein the pump is a first pump and the intelligent sea water cooling system further comprises a second pump configured to circulate fluid through the second fluid cooling loop, and wherein the controller is further configured to shut down the second pump if it is determined that a ratio of an actual flow rate in the system and an optimal flow rate for the system is below a predetermined system efficiency value.

7. The intelligent sea water cooling system of claim 2, wherein if the speed of the pump is reduced to the minimum safe pump speed, the controller is further configured to:

start a timer t2 having a predefined duration; and if the timer t2 expires and the temperature has not increased relative to when the timer t2 was started, incrementally close a discharge valve of the intelligent sea water cooling system to reduce a flow rate in the second fluid cooling loop without reducing the speed of the pump.

8. The intelligent sea water cooling system of claim 7, wherein, if the discharge valve is closed to a max closure, the controller is further configured to:

start a timer t3 having a predefined duration; and if the timer t3 expires and the temperature has not increased relative to when the timer t3 was started, shut down the pump.

9. The intelligent sea water cooling system of claim 8, wherein, if the pump is shut down and the temperature rises into the preferred operating range, the controller is further configured to restart the pump.

10. The intelligent sea water cooling system of claim 8, wherein the pump is a first pump and the intelligent sea water cooling system further comprises a second pump configured to circulate fluid through the second fluid cooling loop, and wherein the controller is further configured to shut down the second pump if it is determined that one-pump operation is more efficient than two-pump operation.

11. A method of operating an intelligent sea water cooling system, the intelligent sea water cooling system including a first fluid cooling loop coupled to a first side of a heat exchanger and to a thermal load, a second fluid cooling loop coupled to a second side of the heat exchanger, and a pump configured to circulate fluid through the second fluid cooling loop, the method comprising:

monitoring a temperature in the first fluid cooling loop and adjusting a speed of the pump to keep the temperature within a preferred operating range;

if the speed of the pump is reduced to a predefined minimum pressure pump speed, starting a timer t1 having a predefined duration; and if the timer t1 expires and the temperature has not increased relative to when the timer t1 was started, reducing the speed of the pump below the minimum pressure pump speed.

12. The method of claim 11, wherein reducing the speed of the pump below the minimum pressure pump speed further comprises preventing the speed of the pump from being reduced below a predefined minimum safe pump speed.

13. The method of claim 12, further comprising, if the speed of the pump is reduced to the minimum safe pump speed:

starting a timer t2 having a predefined duration; and if the timer t2 expires and the temperature has not increased relative to when the timer t2 was started, shutting down the pump.

14. The method of claim 13, further comprising, if the pump is shut down and the temperature rises into the preferred operating range, restarting the pump.

15. The method of claim 13, wherein the pump is a first pump and the intelligent sea water cooling system further includes a second pump configured to circulate fluid through the second fluid cooling loop, the method further comprising shutting down the second pump if it is determined that one-pump operation is more efficient than two-pump operation.

16. The method of claim 15, wherein determining that one-pump operation is more efficient than two-pump operation comprises determining that a ratio of an actual flow rate in the system and an optimal flow rate for the system is below a predetermined system efficiency value.

17. The method of claim 12, further comprising, if the speed of the pump is reduced to the minimum safe pump speed:

starting a timer t2 having a predefined duration; and if the timer t2 expires and the temperature has not increased relative to when the timer t2 was started, incrementally closing a discharge valve of the intelligent sea water cooling system to reduce a flow rate in the second fluid cooling loop without reducing the speed of the pump.

18. The method of claim 17, further comprising, if the discharge valve is closed to a max closure:

starting a timer t3 having a predefined duration; and if the timer t3 expires and the temperature has not increased relative to when the timer t3 was started, shutting down the pump.

19. The method of claim 18, further comprising, if the pump is shut down and the temperature rises into the preferred operating range, restarting the pump.

20. The method of claim 18, wherein the pump is a first pump and the intelligent sea water cooling system further comprises a second pump configured to circulate fluid through the second fluid cooling loop, the method further comprising shutting down the second pump if it is determined that one-pump operation is more efficient than two-pump operation.

* * * * *